United States Patent [19]

Katayama et al.

[11] Patent Number: 4,715,778

[45] Date of Patent: Dec. 29, 1987

[54] CENTRIFUGAL COMPRESSOR

[75] Inventors: Kazuso Katayama; Taku Ichiryu; Tsuneyoshi Mitsuhashi; Yasushi Mori; Masanori Kobayashi, all of Takasago, Japan

[73] Assignee: Mitsubishi Jukogyo Kabushiki Kaisha, Tokyo, Japan

[21] Appl. No.: 857,490

[22] Filed: Apr. 30, 1986

[30] Foreign Application Priority Data

Apr. 1, 1986 [JP] Japan ..... 61-47097[U]

[51] Int. Cl.[4] ..... F01D 3/04

[52] U.S. Cl. ..... 415/104; 415/201; 415/219 C

[58] Field of Search ..... 415/104, 107, 105, 201, 415/118, 213 A, 219 R, 219 A, 219 C

[56] References Cited

U.S. PATENT DOCUMENTS

| | | | |
|---|---|---|---|
| 900,966 | 10/1908 | Sulzer | 415/201 |
| 2,326,112 | 8/1943 | Zetterquist | 415/104 |
| 2,601,828 | 7/1952 | Lobanoff | 415/201 |
| 2,746,671 | 4/1950 | Newcomb | 415/115 |
| 3,370,542 | 2/1968 | Harney | 415/118 |
| 3,861,825 | 1/1975 | Blom | 415/104 |

FOREIGN PATENT DOCUMENTS

| | | | |
|---|---|---|---|
| 1280055 | 11/1970 | Fed. Rep. of Germany . | |
| 77856 | 4/1955 | Netherlands | 415/104 |
| 7712699 | 5/1979 | Netherlands | 415/104 |
| 754113 | 8/1980 | U.S.S.R. | 415/104 |

*Primary Examiner*—Robert E. Garrett
*Assistant Examiner*—John T. Kwon
*Attorney, Agent, or Firm*—Wenderoth, Lind & Ponack

[57] ABSTRACT

A centrifugal compressor of the type in which disassembly and assembly of the compressor is effected by taking out and inserting internal component parts including end walls for closing ends of a cylindrical rotor chamber wall from and into a cylindrical rotor chamber in the axial direction thereof, including intake chamber side communication holes communicating with an intake chamber formed within the cylindrical rotor chamber and a propelling force balance chamber side communication hole communicating with a propelling force balance chamber formed within the cylindrical rotor chamber. The intake chamber side communication holes are formed in the internal component part and in the cylindrical rotor chamber wall, respectively. The propelling force balance chamber side communication holes are respectively provided in an inner axial end surface of the cylindrical rotor chamber wall and an end wall removably fitted in the cylindrical rotor chamber wall with a portion of the end wall abutting the inner axial end surface of the cylindrical rotor chamber wall. The intake chamber side communication hole and the propelling force balance chamber communication hole provided in the cylindrical rotor chamber wall are communicated with each other through a balance pipe mounted on an outer surface of the cylindrical rotor chamber wall.

9 Claims, 4 Drawing Figures

CENTRIFUGAL COMPRESSOR

BACKGROUND OF THE INVENTION

1. Field of the Invention

The present invention relates to a centrifugal compressor of the type in which disassembly and assembly of the compressor is effected by taking out and inserting internal component parts including end walls for closing ends of a cylindrical rotor chamber wall from and into the cylindrical rotor chamber in the axial direction thereof.

2. Description of the Prior Art

At first, a prior art four-stage centrifugal horizontal split type compressor will be discussed with reference to FIG. 2. In this figure, reference numeral (1) designates a cylindrical rotor chamber wall, numeral (2) designates a main shaft (rotary shaft), numeral (3) designates an intake port, numeral (4) designates a delivery port, numeral (5) designates an intake chamber communicating with the intake port (3), numeral (6) designates an impeller fixedly fitted around the main shaft (2), numeral (7) designates a diffuser, numeral (8) designates a return flow passageway, numeral (9) designates a balance piston fixed to the main shaft (2) on the side of the delivery port (4), numeral (10) designates a propelling force balance chamber formed between the balance piston (9) and an inner axial end surface the rotor chamber wall (1) facing the balance piston (9), numeral (11) designates a balance pipe having its opposite end portions fixedly secured to an outer surface of the rotor chamber wall (1), and the balance pipe (11) is in fluid communication with the above-mentioned propelling force balance chamber (10) and with the aforementioned intake chamber (5). In addition, reference numerals (12) and (13) designate thrust bearings.

In operation, fluid is sucked through the intake port (3) into the intake chamber (5), then it is pressurized and accelerated by the impeller (6) fixedly fitted around the main shaft (2), after the energy of velocity (kinetic energy) has been converted into the energy of pressure (internal energy) by the diffuser (7), the fluid is led through the return flow passageway (8) to an inlet of an impeller in the next stage, then it is pressurized and accelerated by the impeller (6) similarly to the above, and after the energy of velocity has been converted into the energy of pressure by the diffuser (7), the fluid is led through the return flow passageway (8) to an inlet of an impeller in the next stage, and is finally delivered from the delivery port (4). Then, due to differences between fluid pressures exerted upon the opposite sides of the impeller (6) in the respective stages, the rotor including the main shaft (2) and the impellers (6) is propelled from the side of the delivery port (4) towards the side of the intake port (3). Therefore, the balance piston (9) is fixedly secured to the main shaft (2) on the side of the delivery port (4) to form a propelling force balance chamber (10) between the balance chamber piston (9) and an inner axial end surface of the rotor chamber wall (1) facing the balance piston (9). On the other hand, the propelling force balance chamber (10) and the intake chamber (5) are communicated with each other through the balance pipe (11) fixedly secured to the outer surface of the rotor chamber wall (1) to bring the pressure within the propelling force balance chamber (10 close to the pressure within the intake chamber (5), thus the rotor including the main shaft (2) is propelled in the opposite direction by the pressure difference between the front and rear sides of the balance piston (9) to balance out the rotor propelling force, and the residual propelling force towards the intake chamber (5) is supported by the thrust bearings (12) and (13) to prevent the rotor from moving in the axial direction.

In a multi-stage centrifugal compressor operating at a high pressure or a centrifugal compressor dealing with a combustible gas, for the purpose of carrying out inspection and the like, provision is made such that disassembly and assembly of the compressor can be effected by taking out or inserting internal component parts including end walls of a cylindrical rotor chamber wall from and into the cylindrical rotor chamber in the axial direction thereof. A centrifugal compressor having a vertically severing type structure, in which the respective component parts to be mounted within a cylindrical rotor chamber wall can be severed in the direction perpendicular to the axis and can be taken out and inserted in the axial direction, is called a "barrel type centrifugal compressor", and its examples in the prior art are illustrated in FIGS. 3 and 4.

In a centrifugal compressor illustrated in FIG. 3, a rotor chamber is constructed of a cylindrical rotor chamber wall (1*a*) and end walls (1*b*) and (1*c*) closing the opposite ends of the cylindrical rotor chamber wall (1*a*), an intake chamber (5) is formed inside of the end wall (1*b*), a propelling force balance chamber (10) is formed between a balance piston (9) fixedly secured to main shaft (2) and the end wall (1*c*), a communication hole ($1b_1$) is drilled in the end wall (1*b*), a communication hole ($1c_1$) is drilled in the end wall (1*c*), one end of a first balance pipe section (11*a*) is fixedly secured to the outer surface of the end wall (1*b*), one end of a third balance pipe section (11*c*) is fixedly secured to the outer surface of the end wall (1*c*), flanges provided at the opposite ends of the above-described respective balance pipe sections (11*a*) and (11*c*) are detachably mounted, via bolts, to flanges provided at the opposite ends of a second balance pipe (11*b*), and threby the propelling force balance chamber (10) and the intake chamber (5) are communicated with each other through the route of the communication hole ($1c_1$)→the third balance pipe section (11*c*)→the second balance pipe section (11*b*)→the first balance pipe section (11*a*)→the communication hole ($1b_1$). Upon disassembly, the second balance pipe section (11*b*) is disengaged from the first and third balance pipe sections (11*a*) and (11*c*), and then the end walls (1*b*) and (1*c*) and the internal component parts (not shown in FIG. 3) are extracted from the interior of the cylindrical rotor chamber wall (1*a*) in the axial direction (in the left and right directions in this example). Once the inspection or the like has been finished, the end walls (1*b*) and (1*c*) and the internal component parts are inserted into the cylindrical rotor chamber wall (1*a*) in the axial direction (in the left and right directions) to be assembled.

In a centrifugal compressor shown in FIG. 4, a rotor chamber is constructed of a cylindrical rotor chamber wall (1*a*) and end walls (1*b*) and (1*c*) closing the opposite ends of the cylindrical rotor chamber wall (1*a*), an intake chamber (5) is formed inside of the end wall (1*b*), a propelling force balance chamber (10) is formed between a balance piston (9) and the end wall (1*c*), a communiation hole ($1c_1$) is drilled in the end wall (1*c*), one end of a first balance pipe section (11*a*) is fixedly secured to a wall of an intake port (3), one end of a third balance pipe section (11*c*) is fixedly secured to the outer surface of the end wall (1*c*), flanges provided at the opposite ends of a second balance pipe section (11*b*) are detachably mounted by means of bolts to flanges provided at the other ends of the respective balance pipe sections (11*a*) and (11*c*), and thereby the propelling force balance chamber (10) is communicated with the intake chamber (5) through the route of the communication hole ($1c_1$)→the third balance pipe section (11*c*)→the second balance pipe section (11*b*)→the first balance pipe section (11*a*)→the intake port (3). Upon disassembly, the second balance pipe section (11*b*) is disengaged from the first and third balance pipe sections (11*a*) and (11*c*), and the end walls (1*b*) and (1*c*) and the internal component parts are extracted from the interior of the cylindrical rotor chamber wall (1*a*) in the axial direction (in the left direction in this example). Once the inspection and the like has been finished, the end walls (1*b*) and (1*c*) and the internal component parts are inserted into the cylindrical rotor chamber wall (1*a*) in the axial direction (in the right direction in this example) to be assembled.

In the horizontally split centrifugal compressors as illustrated in FIG. 2, upon disassembly and assembly of the compressor, it is not necessary to dismount and mount the balance pipe section (11*b*), while in the vertically split type centrifugal compressor in the prior art as illustrated in FIGS. 3 and 4, upon disassembly and assembly of the compressor, it is necessary to dismount and mount the balance pipe section (11*b*), but since the balance pipe section (11*b*) is large in size and heavy in weight, handling thereof is difficult. Moreover, it is necessary to loosen and fasten the bolts for clamping the flanges provided at the opposite ends of the balance pipe section (11*b*) with the flanges provided at the other ends of the balance pipe sections (11*a*) and (11*c*), hence the disassembling and assembling tasks for a centrifugal compressor become complex and troublesome, and so, a working period, a number of working steps and a cost necessitated for disassembly and assembly are increased. In addition, there was a problem that since a large-sized balance pipe section (11*b*) had to be dismounted and mounted, a large working space was required for disassembly and assembly.

SUMMARY OF THE INVENTION

It is therefore one object of the present invention to provide an improved centrifugal compressor, in which a working time, a number of working steps and a cost necessitated for disassembly and assembly of the compressor can be reduced.

Another object of the present invention is to provide an improved centrifugal compressor, in which a working space required for disassembly and assembly of the compressor can be reduced.

According to one feature of the present invention, there is provided a centrifugal compressor of the type that disassembly and assembly of the compressor is effected by taking out and inserting internal component parts including end walls for closing ends of a cylindrical rotor chamber wall from and into the cylindrical rotor chamber in the axial direction thereof, in which an intake chamber side communication hole communicating with an intake chamber formed within the cylindrical rotor chamber and a propelling force balance chamber side communication hole communicating with a propelling force balance chamber formed within the cylindrical rotor chamber, are provided in the internal component parts and in the cylindrical rotor chamber wall, and the intake chamber side communication hole and the propelling force balance chamber side communication hole provided in the cylindrical rotor chamber wall are communicated with each other through a balance pipe mounted on an outer surface of the cylindrical rotor chamber wall.

In the centrifugal compressor according to the present invention, owing to the fact that an intake chamber side communication hole communicating with an intake chamber formed within the cylindrical rotor chamber and a propelling force balance chamber side communiation hole communicating with a propelling force balance chamber formed within the cylindrical rotor chamber are provided in the internal component parts and in the cylindrical rotor chamber wall, and the intake chamber side communication hole and the propelling force balance chamber side communication hole provided in the cylindrical rotor chamber wall are communicated with each other through a balance pipe mounted on an outer surface of the cylindrical rotor chamber wall as described above, the balance pipe is not mounted to the end walls closing the ends of the cylindrical rotor chamber wall, so that upon disassembly and assembly, there is no need to dismount and mount the large-sized balance pipe, and hence a working time, a number of working steps and a cost necessitated for disassembly and assembly can be reduced. In addition, since it is unnecessary to dismount or mount a large-sized balance pipe as described above, a working space can be reduced.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
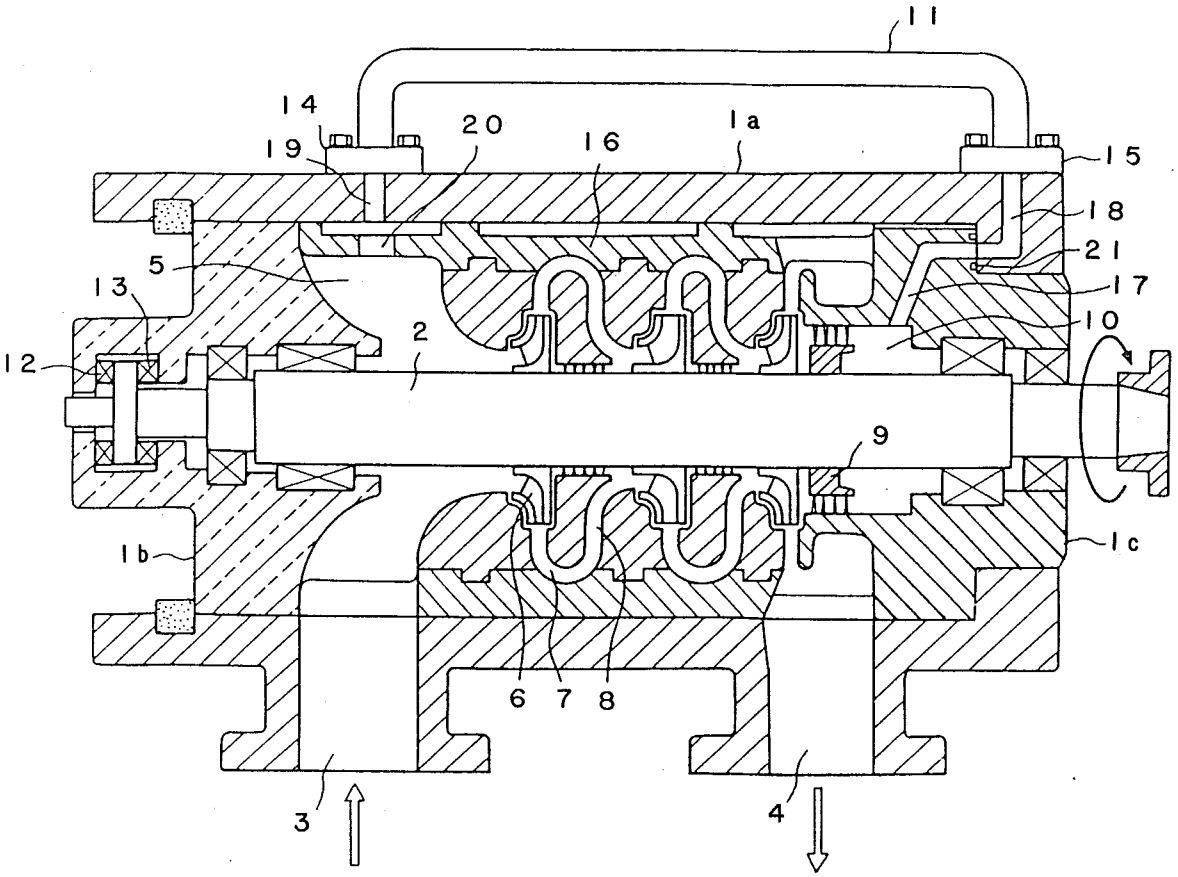
FIG. 1 is a longitudinal cross-sectional side view showing one preferred embodiment of the centrifugal compressor according to the present invention.
Figure 2:
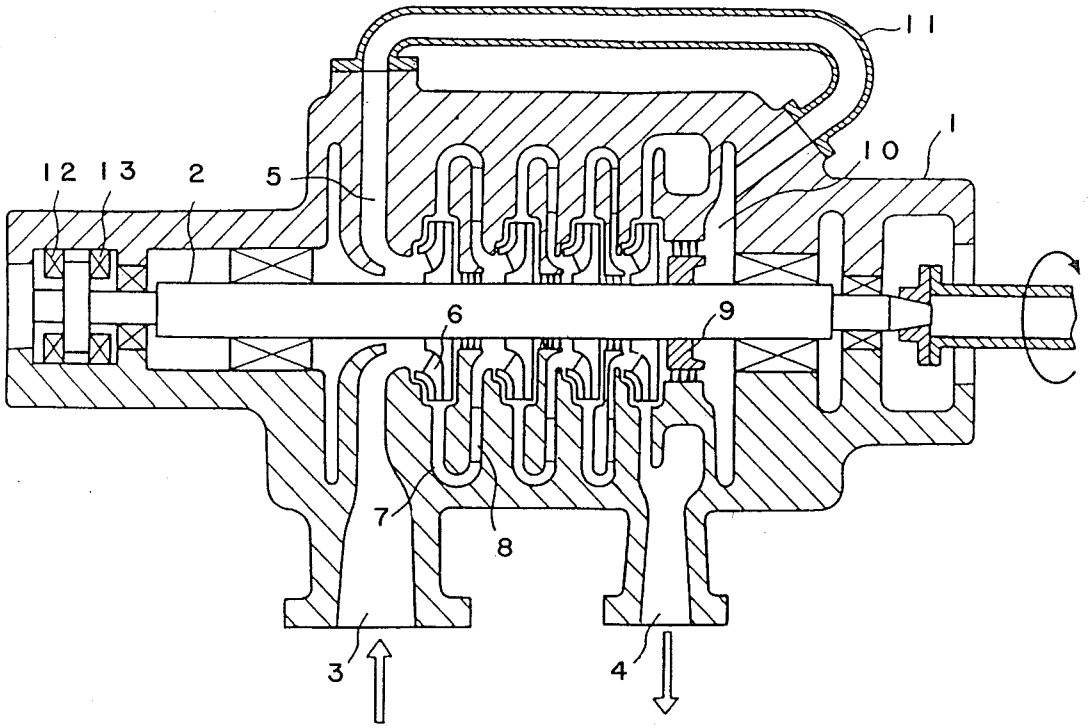
FIG. 2 PRIOR ART
FIG. 2 is a longitudinal cross-section side view showing one example of the centrifugal compressor in the prior art.
Figure 3:
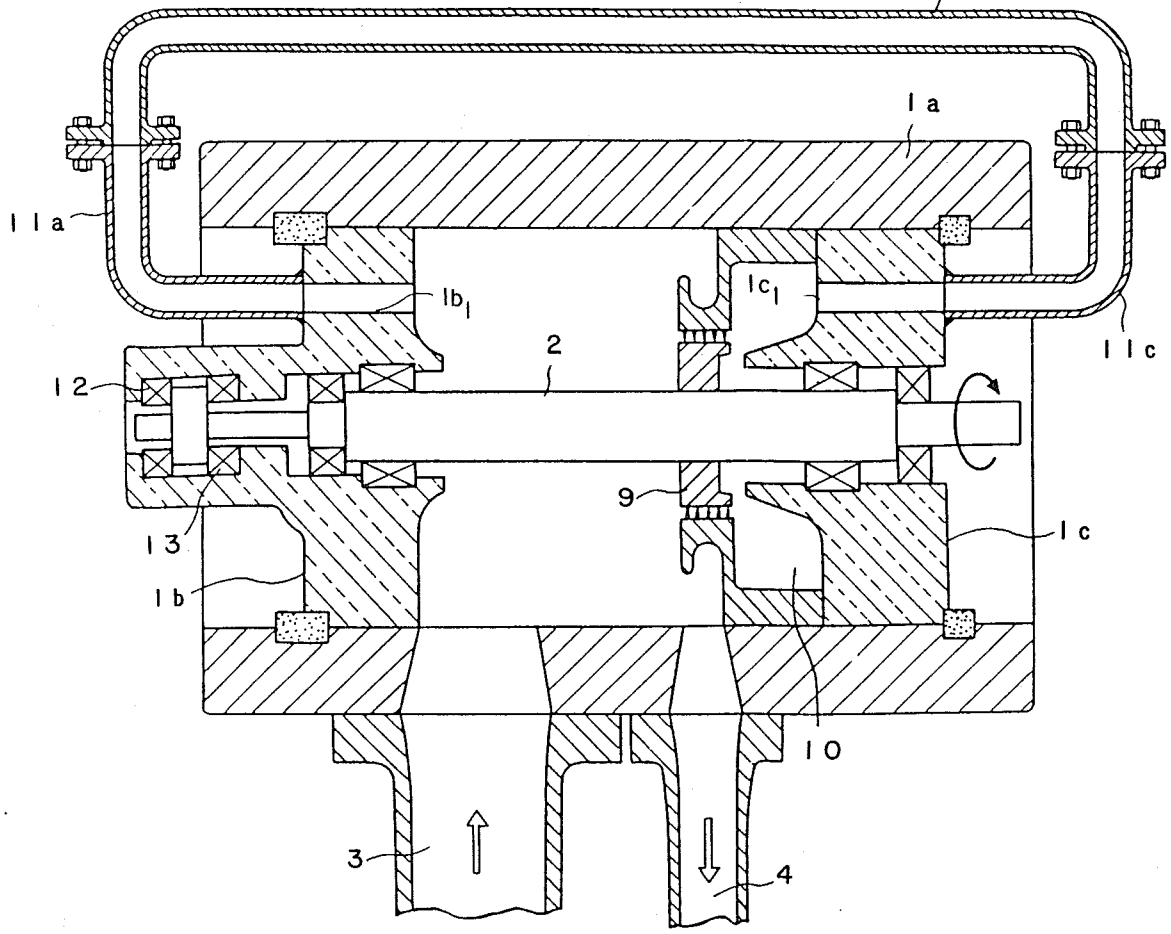
FIG. 3 PRIOR ART
FIGS. 3 and 4, respectively, are longitudinal cross-section side views showing different examples of the centrifugal compressor in the prior art.
Figure 4:
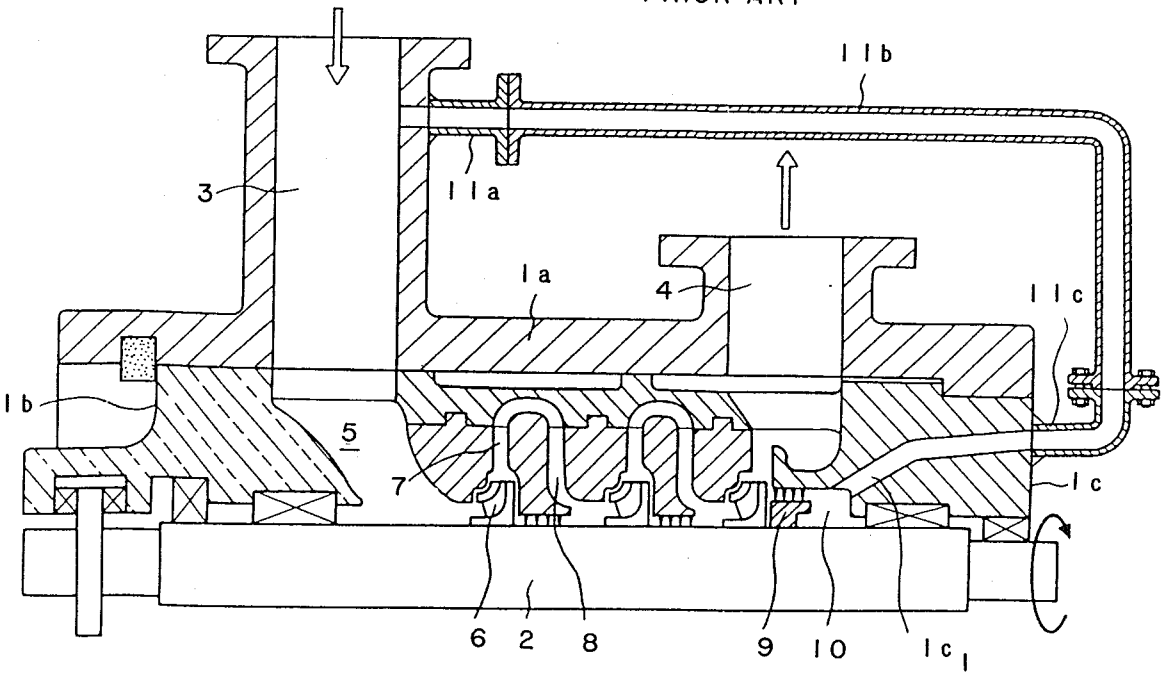
FIG. 4 PRIOR ART

Now, description will be made on one preferred embodiment of the centrifugal compressor according to the present invention illustrated in FIG. 1. In this figure, reference numeral (1*a*) designates a cylindrical rotor chamber wall, numerals (1*b*) and (1*c*) designate end walls for closing the opposite ends of the cylindrical rotor chamber wall (1*a*), numeral (2) designates a main shaft (rotary shaft), numeral (3) designates an intake port, numeral (4) designates a delivery port, numeral (5) designates an intake chamber communicating with the intake port (3), numeral (6) designates impellers fixedly fitted around the main shaft (2), numeral (7) designates a diffuser, numeral (8) designates a return flow passageway, numeral (9) designates a balance piston fixedly secured to the main shaft (2) on the side of the delivery port (4), numeral (10) designates a propelling force balance chamber formed between the balance piston (9) and the end wall (1*c*) positioned outside of the balance piston (9), numeral (11) designates a balance pipe, numerals (14) and (15), respectively, designate flanges fixedly secured to the opposite ends of the balance pipe (11), and these flanges (14) and (15) are detachably secured to the outer surface of the rotor chamber wall (1*a*). Reference numerals (12) and (13) designate thrust bearings, numeral (16) designates an internal component part, numeral (17) designates a propelling force balance chamber side communication hole drilled in the end wall (1*c*), numeral (18) designates a propelling force balance chamber side communication hole provided in an inner axial end surface of the cylindrical rotor chamber wall (1*c*) extending perpendicularly to the axial direction which is parallel to the axis of rotation of the main shaft (2), and numeral (21) designates a seal member for sealing the junction between the propelling force balance chamber side communication hole (17) and the propelling force balance chamber side communication hole (18). Furthermore, an intake chamber side communication hole (19) is provided in the cylindrical rotor chamber wall (1*a*) and an intake chamber side communication hole (20) is provided in the internal component part (16). As can be seen in FIG. 1, the hole (18) extends from the axial end surface of the cylindrical rotor chamber wall (1*a*) in a direction parallel to the axial direction of the main shaft (2).

Next, operation of the centrifugal compressor illustrated in FIG. 1 will be explained in detail. Fluid is sucked through the intake port (3) into the intake chamber (5), then it is pressurized and accelerated by the impeller (6) fixedly fitted around the main shaft (2), after the energy of velocity (kinetic energy) has been converted into the energy of pressure (internal energy) by the diffuser (7), the fluid is led through the return flow passageway (8) to an inlet of an impeller in the next stage, again it is pressurized and accelerated by the impeller (6) similarly to the above, after the energy of velocity has been converted into the energy of pressure by the diffuser (7) it is led through the return flow passageway (8) to an inlet of an impeller in the next stage, and finally it is delivered from the delivery port (4). At this time, due to differences between the fluid pressures exerted upon the opposite sides of the impellers (6) in the respective stages, the rotor including the main shaft (2) is propelled from the side of the delivery port (4) towards the side of the intake port (3). However, the balance piston (9) is fixedly secured to the main shaft (2) on the side of the delivery port (4), and thereby the propelling force balance chamber (10) is formed between the balance piston (9) and the inner surface of the rotary chamber end wall (1*c*) facing the balance piston (9). The propelling force balance chamber (10) and the intake chamber (5) are communicated with each other through the route of the propelling force balance chamber side communication hole (17) provided in the end wall (1*c*)→the propelling force balance chamber side communication hole (18) provided in the cylindrical rotor chamber wall (1*a*)→the intake chamber side communication (19) provided in the cylindrical rotor chamber wall (1*a*)→the intake chamber side communication hole (20) provided in the internal component part (16), hence the pressure within the propelling force balance pressure (10) becomes close to the chamber within the intake chamber (5), thus the rotor including the main shaft (2) is propelled in the opposite direction by the pressure difference exerted upon the front and rear sides of the balance piston (9) to balance out the propelling force exerted upon the rotor, the residual propelling force directed towards the intake chamber (5) is supported by the thrust bearings (12) and (13), and thereby the rotor is prevented from moving in the axial direction.

When the compressor is disassembled upon inspection and the like, the end walls (1*b*) and (1*c*), the internal component part (16) and the like are extracted in the axial direction (in the lefthand direction in the illustrated embodiment) from the interior of the one piece cylindrical rotor chamber wall (1*a*). Whereas, when it is assembled, the above-described respective component parts are inserted into the cylindrical rotor chamber wall (1*a*) in the axial direction. During the disassembly and assembly, the balance pipe (11) is kept mounted on the outer surface of the cylindrical rotor chamber wall (1*a*).

In the centrifugal compressor according to the present invention, owing to the fact that an intake chamber side communication hole communicating with an intake chamber formed within a cylindrical rotor chamber and a propelling force balance chamber side communication hole communicating with a propelling force balance chamber formed within the cylindrical rotor chamber are provided in internal component parts and in a cylindrical rotor chamber wall, the intake chamber side communication hole and the propelling force balance chamber side communication hole provided in the cylindrical rotor chamber wall are communicated with each other through a balance pipe mounted on the outer surface of the cylindrical rotor chamber wall, and the balance pipe is not mounted to either end wall for closing the end of the cylindrical rotor chamber wall as described above. As such, upon disassembly and assembly of the compressor there is no need to dismount and mount a large-sized balance pipe, and so, a working period, a number of working steps and a cost necessitated for disassembly and assembly can be reduced. In addition, since there is no need to dismount and mount a large-sized balance pipe as described above, there is an advantage that a working space can be reduced.

If the high pressure fluid at the delivery port (4) should infiltrate into the junction between the communication hole (17) and the communication hole (18), the thrust balance is destroyed, leading to an accident. Therefore, a complete sealing is required. In the present invention, an end surface perpendicular to the axial line is formed at this junction, and on this end surface, a connection hole is provided, resulting that a complete sealing is secured by making use of a surface pressure generated on this end surface by the high pressure in the delivery port (4). The seal member (21) is provided for the purpose of strengthening the sealing performance, but even if this seal member should be deteriorated to the extent of being functionally disordered, the sealing performance is not fatally impaired, thus very high reliability being secured.

Since many changes and modifications in design can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. A centrifugal compressor of the type in which disassembly and assembly of said compressor is effected by taking out and inserting internal component parts including end walls for closing ends of a cylindrical rotor chamber in the axial direction thereof; characterized in that an intake chamber side communication hole communicating with an intake chamber formed within said cylindrical rotor chamber and a propelling force balance chamber side communication hole communication with a propelling force balance chamber formed within said cylindrical rotor chamber, are provided in said internal component parts and in said cylindrical rotor chamber wall, and the intake chamber side communication hole and the propelling force balance chamber side communication hole provided in said cylindrical rotor chamber wall are communicated with each other through a balance pipe mounted on an outer surface of said cylindrical rotor chamber wall, the propelling force balance chamber side communication hole in the cylindrical rotor chamber wall being formed in an inner axial end surface of the cylindrical rotor chamber wall, the inner axial end surface extending perpendicularly to the axial direction.

2. A centrifugal compressor comprising:

a cylindrical rotor chamber wall having an inner surface thereof extending in an axial direction and having an inner axial end surface extending from said inner surface;

a first end wall removably fitted in said cylindrical rotor chamber wall, said first end wall having a portion thereof abutting said inner axial end surface of said cylindrical rotor chamber wall;

a second end wall removably fitted in said cylindrical rotor chamber;

means in said cylindrical rotor chamber wall for defining an intake chamber adjacent said second wall and a propelling force balance chamber adjacent said first end wall;

an intake chamber side communication hole in said cylindrical rotor chamber wall communicating with said intake chamber;

a first propelling force balance chamber side communication hole in said first end wall communicating with said propelling force balance chamber;

a second propelling force balance chamber side communication hole in said cylindrical rotor chamber wall communicating with said first propelling force balance chamber side communication hole, said second propelling force balance chamber side communication hole being formed in said inner axial end surface of said cylindrical rotor chamber wall; and a balance pipe mounted on an outer surface of said cylindrical rotor chamber wall communicating with said intake chamber side communication hole and with said second propelling force balance chamber side communication hole.

3. The centrifugal compressor of claim 2, wherein said inner axial end surface of said cylindrical rotor chamber wall extends in a direction perpendicular to said axial direction and said cylindrical rotor chamber wall is of one-piece construction.

4. The centrifugal compressor of claim 2, wherein said means includes an internal component part disposed along said inner surface of said cylindrical rotor chamber wall, said internal component part including an intake chamber side communication hole communicating with said intake chamber and with said intake chamber side communication hole in said cylindrical rotor chamber wall.

5. The centrifugal compressor of claim 2, further including seal member means disposed between said portion of said first end wall and said inner axial end surface of said cylindrical rotor chamber wall for sealing the junction between said first propelling force balance chamber side communication hole and said second propelling force balance chamber side communication hole.

6. The centrifugal compressor of claim 2, wherein said cylindrical rotor chamber wall includes a main shaft supported for rotation by said first end wall and said second end wall, a balance piston mounted on said main shaft with a space between said balance piston and said first end wall defining said propelling force balance chamber.

7. The centrifugal compressor of claim 2, wherein said first end wall includes a portion having a surface parallel to said axial direction and facing said propelling force balance chamber, said first propelling force balance chamber side communication hole extending through said surface of said first end wall facing said propelling force balance chamber.

8. The centrifugal compressor of claim 2, wherein said second propelling force balance chamber side communication hole extends from said inner axial end surface in a direction parallel to said axial direction.

9. An improved structure for a centrifugal compressor comprising:

a cylindrical rotor chamber wall having an inner surface thereof extending in an axial direction and having an inner axial end surface extending from said inner surface in a direction perpendicular to said axial direction;

a first end wall removably fitted in said cylindrical rotor chamber wall, said first end wall having a portion thereof abutting said inner axial end surface of said cylindrical rotor chamber wall;

an intake chamber side communication hole in said cylindrical rotor chamber wall communicating with an intake chamber inwardly of said cylindrical rotor chamber wall;

a first propelling force balance chamber side communication hole in said first end wall communicating with a propelling force balance chamber inwardly of said cylindrical rotor chamber wall; and a second propelling force balance chamber side communication hole in said cylindrical rotor chamber wall communicating with said first propelling force balance chamber side communication hole, said second propelling force balance chamber side communication hole being formed in said inner axial end surface of said cylindrical rotor chamber wall, said intake chamber side communication hole and said second propelling force balance chamber side communication hole adapted for connection to a balance pipe mounted on an outer surface of said cylindrical rotor chamber wall.

* * * * *